United States Patent [19]

Langen et al.

[11] Patent Number: 4,856,270

[45] Date of Patent: Aug. 15, 1989

[54] AUTOMATED TEXTILE THREAD PROCESSING SYSTEM

[75] Inventors: Manfred Langen, Monchen-Gladbach; Heinz Fink, Krefeld, both of Fed. Rep. of Germany

[73] Assignee: Palitex Project Company GmbH, Krefeld, Fed. Rep. of Germany

[21] Appl. No.: 142,657

[22] Filed: Jan. 11, 1988

[30] Foreign Application Priority Data

Jan. 10, 1987 [DE] Fed. Rep. of Germany ... 8700472[U]

[51] Int. Cl.[4] ..... D01H 9/18; B61B 3/00; B65H 67/06; E01B 25/22

[52] U.S. Cl. ..... 57/281; 57/266; 57/270; 57/276; 104/89; 104/91; 242/35.5 R

[58] Field of Search ..... 57/266, 268, 270, 276, 57/281, 277, 278; 242/35.5 R, 35.5 A; 104/89–91

[56] References Cited

U.S. PATENT DOCUMENTS

| | | | |
|---|---|---|---|
| 3,429,113 | 2/1969 | Nimtz et al. | 57/281 |
| 3,534,539 | 10/1970 | Franzen et al. | 57/281 |
| 3,599,413 | 8/1971 | Nimtz et al. | 57/281 X |
| 3,828,682 | 8/1974 | Klein | 57/281 X |
| 3,884,026 | 5/1975 | Yoshizawa et al. | 57/281 |
| 3,906,712 | 9/1975 | Miyazaki et al. | 57/281 |
| 3,935,821 | 2/1976 | Maier et al. | 57/281 X |
| 4,023,339 | 5/1977 | Laderach et al. | 104/91 X |
| 4,586,326 | 5/1986 | Igel | 57/276 X |
| 4,721,262 | 1/1988 | Langen | 242/35.5 A |

FOREIGN PATENT DOCUMENTS 1685944 4/1972 Fed. Rep. of Germany .

*Primary Examiner*—John Petrakes

*Attorney, Agent, or Firm*—Bell, Seltzer, Park & Gibson

[57] ABSTRACT

An automated thread processing system is characterized by reducing thread package handling and labor requirements. The system includes a textile thread processing machine station having a plurality of spindle assemblies for processing thread and forming wound packages of thread. At least one additional station is also provided. A thread package transporting mechanism includes a stationary continuous rail passing through the thread processing machine station and to and through the additional station and back to the thread processing machine station. Thread package carrying devices are movably mounted on the rail and positioned for receiving the wound packages of thread doffed from the spindle assemblies of the thread processing machine station and then carrying the thread packages from the thread processing machine station to the additional station and releasing the thread packages at the additional station and then returning to the thread processing machine station. Drive mechanisms are provided for driving the thread package carrying devices along the rail.

18 Claims, 6 Drawing Sheets

AUTOMATED TEXTILE THREAD PROCESSING SYSTEM

FIELD OF THE INVENTION

This invention relates to an automated textile thread processing system characterized by reduced thread package handling and labor requirements. More particularly, the automated thread processing system includes a thread processing machine station, such as a twisting, spinning and the like machine, having a plurality of spindle assemblies for processing thread and forming wound packages of processed thread and being arranged on the machine in two longitudinally-extending rows on opposite sides of the machine and in spaced side-by-side relationship. At least one additional station, such as a thread processing machine, packaging mechanism, fabric producing machine, thread package receptacle and the like, is provided. A thread package transporting mechanism passes through such stations for receiving the wound packages of thread doffed from each of the spindle assemblies of the thread processing station and carries the thread packages therefrom to the additional station and releases the thread packages at the additional station and then returns to the thread processing machine station.

BACKGROUND OF THE INVENTION

Heretofore, the handling of doffed wound thread packages from spindle assemblies of thread processing machines, such as twisters, spinning frames, winders and the like, has been either manually by an operator in doffing each of the wound thread packages from the various spindle assemblies or by a conveyor belt type mechanism which receives the doffed wound thread packages either from an automatic doffing mechanism or by manual doffing and which carries the doffed wound thread packages to the end of the machine at which location the wound thread packages are transferred in some manner, usually manually, into a package container or are handed over to another mechanism present at the end of the machine. The wound thread packages are then transported to additional thread processing stations, such as twisters, winders, creels, packaging mechanisms, looms, knitting machines, etc. Such prior operations may be seen, for example from U.S. Pats. 3,429,113; 3,534,539 and 3,599,413 and German patent specifications DE-PS 16 85 944, all of which are assigned to the assignee of the present application.

These types of thread processing systems and package handling operations necessarily require an extensive amount of operator time and labor requirements and are therefore expensive in textile manufacturing.

OBJECTS AND SUMMARY OF THE INVENTION

It is the object of this invention to provide an automated thread processing system which is characterized by reducing the above described thread package handling and labor requirements.

In accordance with this invention, it has been found that the above object may be accomplished by providing an automated textile thread processing system including generally the following.

A textile thread processing machine station, such as a twisting, spinning and the like machine, is provided which has a plurality of spindle assemblies for processing thread and forming wound packages of processed thread. The spindle assemblies are arranged on the machine in two longitudinally-extending rows on opposite sides of the machine and in spaced side-by-side relationship. At least one additional station, such as a thread processing machine, packaging mechanism, fabric producing machine, thread package receptacle, and the like, is provided.

A thread package transporting mechanism is incorporated with the above stations which comprises an elongate stationary continuous rail device passing through the thread processing machine station between the rows of spindle assemblies and to and through the additional station and back to the thread processing machine. Thread package carrying devices are movably mounted on the rail device and positioned for receiving the wound packages of thread doffed from the spindle assemblies of the thread processing machine station and then carrying the thread packages from the thread processing machine station to the additional station and releasing the thread packages at the additional station and then returning to the thread processing machine station. Drive devices are provided for driving the thread package carrying devices along the rail device, preferably in a group of a predetermined number.

Preferably, the rail device extends in the form of and defines a closed loop. The closed loop preferably exits one end of the thread processing machine station and enters the other end of the thread processing machine station. The rail device preferably further includes a gate mechanism positioned for being moved from a first position wherein the closed loop exits one end of the thread processing machine and enters the other end of the thread processing machine to a second position bypassing the portion of the closed loop which enters the other end of the thread processing machine and forms and defines a second closed loop which exits and enters the one end of the thread processing machine, whereby a choice of closed loop travel is provided for the thread package carrying devices. The thread processing system may also include a second additional station, such as a thread processing machine, packaging mechanism, fabric producing machine, thread package receptacle and the like, positioned so that the portion of the rail device, forming the closed loop when the gate is in its first position, passes therethrough.

The thread package carrying device may preferably be in the form of a three dimensional framework having a generally triangular transverse cross-section, a generally rectangular bottom, a width less than the diameter of the wound thread package, a height greater than the wound thread package, a length greater than the wound thread package, and open sides to receive the doffed wound thread package therethrough, along with an open bottom for cradling the doffed wound thread package on the framework.

Alternatively, the thread package carrying device may comprise a three dimensional framework comprising spaced-apart opposed longitudinally-extending portions each having open sides and bottom areas and dimensions for receiving therein and cradling the doffed wound thread package at the bottom areas. The opposed portions are pivotally mounted at the top areas thereof to move from a first position wherein the bottom areas are spaced-apart a distance less than the diameter of the wound thread package for receiving, cradling and carrying the doffed wound thread package to a second position wherein the bottom areas are spaced-apart a distance greater than the diameter of the wound thread package for opening the thread package carrying device and releasing the wound thread package therefrom. Preferably, the pivotally mounted portions of the framework comprise generally two-arm lever like systems pivoted about a generally horizontal axis and the bottom area thereof comprises generally gripping tong like members. Devices are preferably operative connected with the pivotally mounted portions of the framework for selectively moving the pivotally mounted portions to the second position and opening the thread package carrying devices.

BRIEF DESCRIPTION OF THE DRAWINGS

Some of the objects and advantages of this invention have been set forth above, other objects and advantages will become apparent when considering the following detailed description of a preferred embodiment of this invention, when taken in conjunction with the accompanying drawings in which.

DETAILED DESCRIPTION OF PREFERRED EMBODIMENTS OF THE INVENTION

Figure 1:
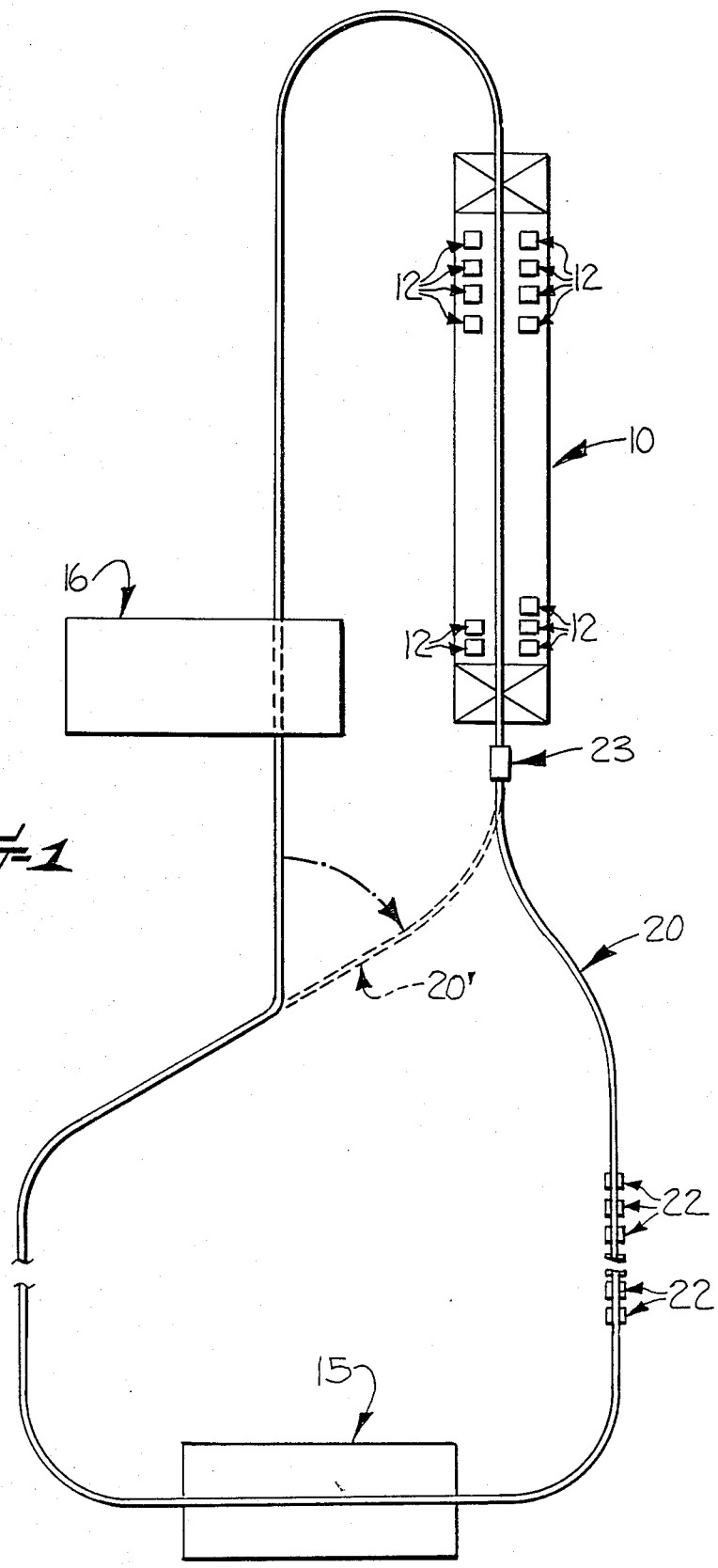
FIG. 1 is a schematic plan view of an automated textile thread processing system in accordance with this invention.

Referring now to the drawings, there is illustrated schematically in FIG. 1 a layout of the automated textile thread processing system in accordance with this invention. As illustrated therein, the automated textile thread processing system includes a textile thread processing machine station 10 which as illustrated in the drawings is in the form of a two-for-one twister textile thread processing machine; however, it is to be understood that this thread processing machine could be any type of twisting, spinning and the like machine which form or receive wound packages P of processed thread T.

Figures 2, 3:
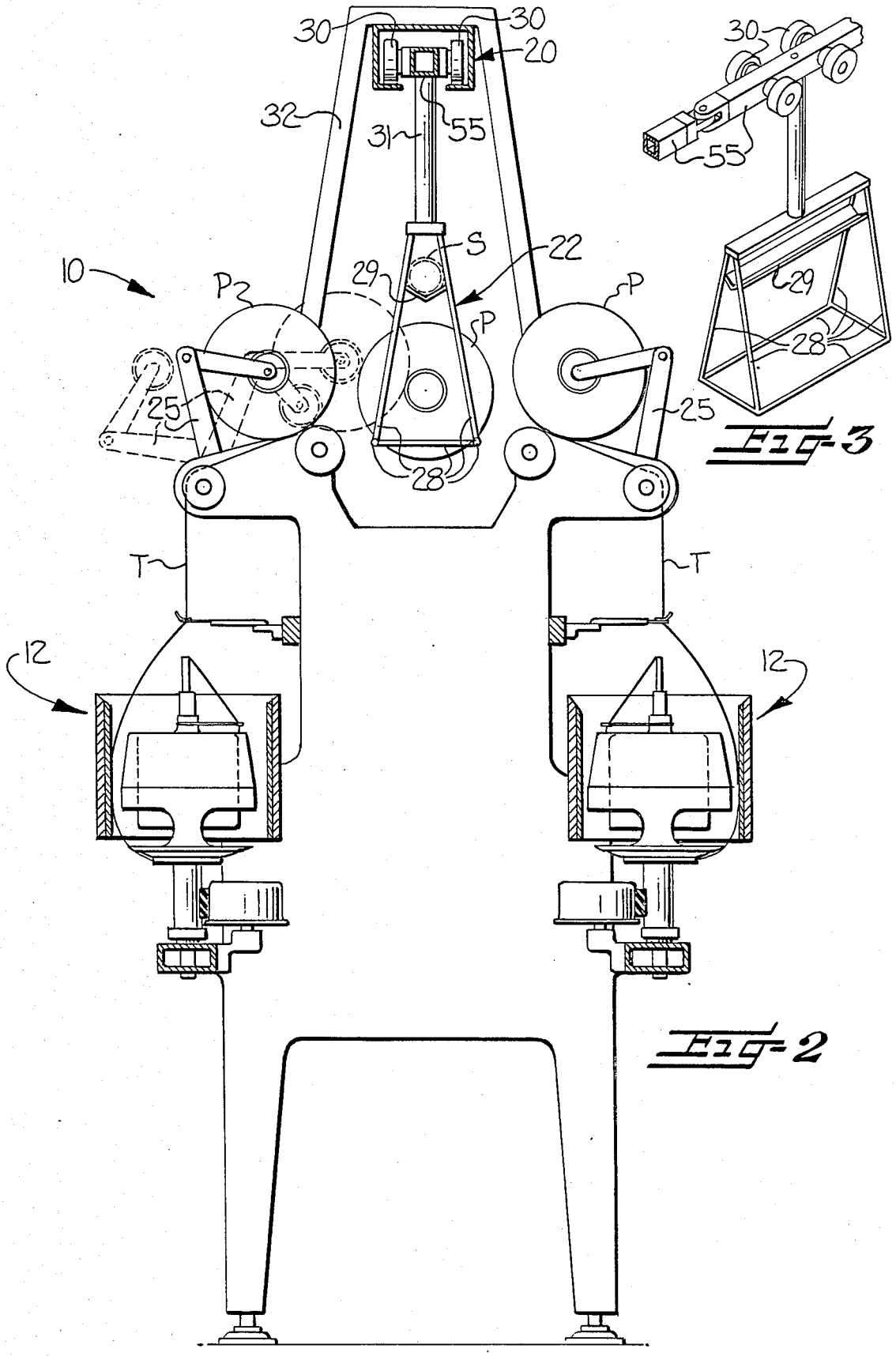
FIG. 2 is a sectional elevational view taken through a two-for-one twister textile thread processing machine having incorporated therein the thread package transporting mechanism including a first embodiment of a thread package carrying device in accordance with this invention.
FIG. 3 is a perspective view of the first embodiment of a thread package carrying device, as illustrated in FIG. 2.
Figure 4:
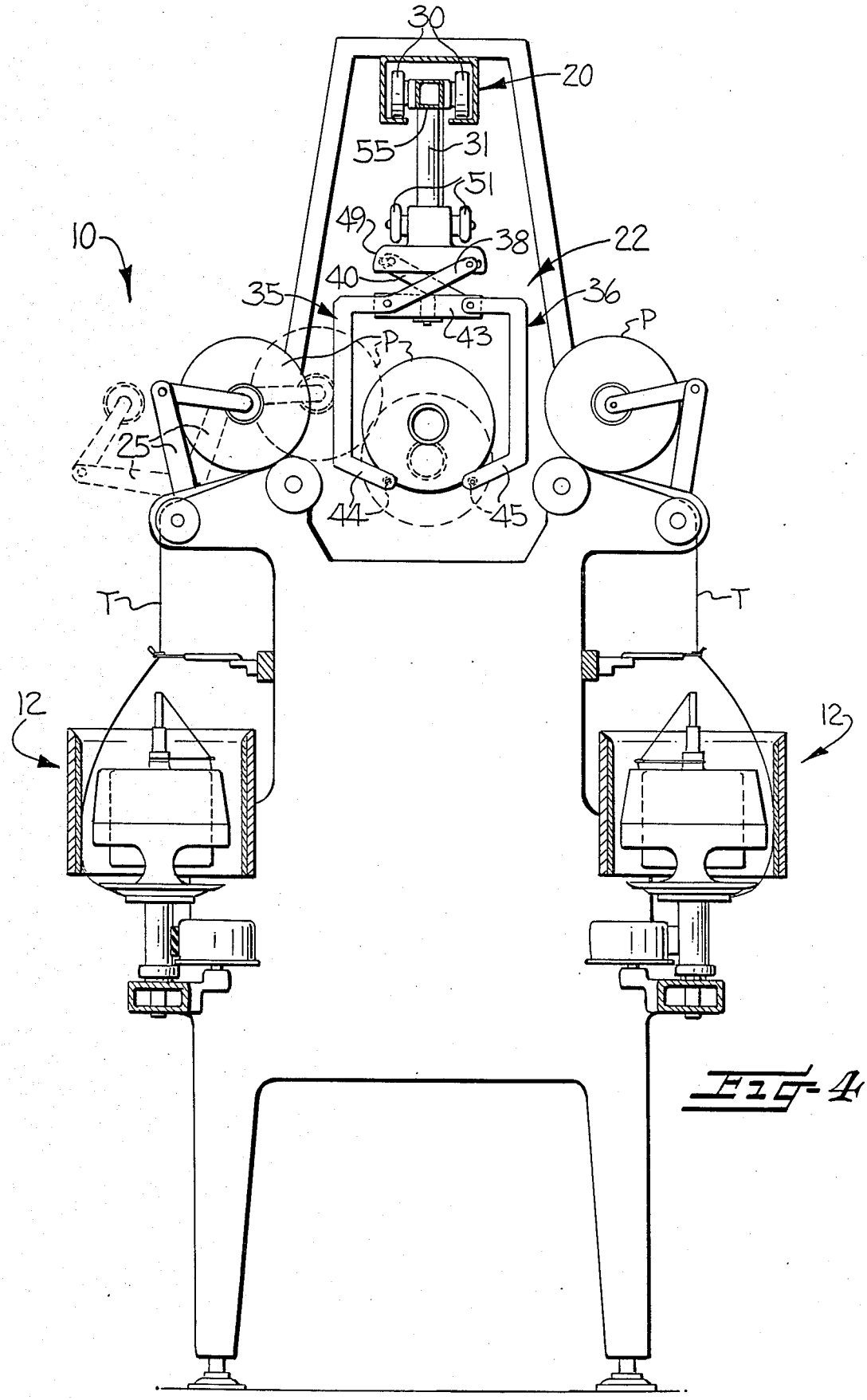
FIG. 4 is a sectional elevational view, like FIG. 2, taken through a two-for-one twister textile thread processing machine having incorporated therein the thread package transporting mechanism including a second embodiment of a thread package carrying device in accordance with this invention.

As may be seen schematically in FIG. 1 and in FIGS. 2 and 4, the two-for-one twister thread processing machine includes a plurality of spindle assemblies 12 for processing thread T and forming the wound packages P of processed thread T. The spindle assemblies 12 of such two-for-one twister textile thread processing machine 10, as well as other types of thread processing machines, are arranged on the machine 10 in two longitudinally-extending rows on opposite sides of the machine 10 and in spaced side-by-side relationship, as may be seen schematically in FIG. 1 and in FIGS. 2 and 4. The operation of such spindle assemblies 12 in a two-for-one twister textile thread processing machine 10 to form wound packages P of thread T is well understood by those with ordinary skill in the art and further explanation herein is not deemed necessary for an understanding of the present invention.

The automated textile thread processing system of this invention includes at least one additional station 15, which may be a further thread processing machine of the type discussed above, packaging mechanism, fabric producing machine in the form of a loom or knitting machine, thread package receptacle or other desired machine. The automated textile thread processing system may further include a second additional machine 16 which may be any of the above types of machines or mechanism, as desired in the thread processing system.

The thread processing system further includes a thread package transporting mechanism which includes an elongate stationary continuous rail 20 which passes through the thread processing machine station 10 between the rows of spindle assemblies 12 and then to and through the additional station or stations 15, 16 and back to the thread processing machine 10. Thread package carrying means or devices 22 are movably mounted on the rail 20 and positioned for receiving the wound thread packages P doffed from each of the spindle assemblies 12 of the thread processing machine station 10 and then carrying the thread packages P from the thread processing machine station 10 to the additional station or stations 15, 16 and releasing and/or picking up the thread packages P at the additional station or stations 15, 16 and ultimately returning to the thread processing machine station 10. Drive means 23, as will be described below, are provided for driving the thread package carrying devices 22 along the rail 20.

Various configurations of the rail 20 may be provided in the automated textile thread processing system, as desired above. As shown in FIG. 1, the rail 20 extends in the form of and defines a closed loop. This closed loop may exit one end of the thread processing machine station 10 and enter the other end of the thread processing machine station 10. The rail 20 may also include a gate device 20' which may be in any suitable form wherein a rail section is movable from a first position, as shown in solid lines in FIG. 1, wherein the closed loop of the rail 20 exits one end of the thread processing machine 10 and enters the other end of the thread processing machine 10 to a second position, as indicated in dotted lines in FIG. 1, which forms a closed loop bypassing the portion of the closed loop described above which enters the other end of the thread processing machine 10 and forms and defines a second closed loop which exits and enters the one end of the thread processing machine 10. With this arrangement, a choice of closed loop travel is provided for the thread package carrying devices 22. The second additional station 16 may be positioned along the rail in such a location that it can be bypassed by operation of the gate means 20', as indicated schematically in FIG. 1. Various arrangements of the rail 20 in the form of closed or open loops may be provided depending upon the additional stations desired in the thread processing system and the alternatives disclosed in FIG. 1 are just some of those arrangements.

As illustrated in FIGS. 2 and 4, a device 25 is preferably provided with each spindle assembly 12 of the thread processing machine station 10 for doffing the wound thread packages P from each of the spindle assemblies 10 into one of the thread package carrying devices 22 of the thread package transporting mechanism. One form of such doffing device is illustrated herein and the operation of which is described in the above identified German patent specifications DE-PS 16 85 944. The construction and operation of such doffing device may be seen from that German patent specification and full details of the construction and operation thereof are not deemed necessary herein for full understanding of the present invention. Also, other thread package doffing devices are available and could be utilized.

Referring now to FIGS. 2 and 3, a first embodiment of a thread package carrying device 22 in accordance with this invention is illustrated therein. This embodiment of thread package carrying device 22 comprises a three dimensional framework 28 having a generally triangular transverse cross section, a general rectangular bottom, a width less than the diameter of the wound thread package P, a height greater than the wound thread package P, a length greater than the wound thread package P, open sides to receive the doffed wound thread package P therethrough, and an open bottom for cradling the doffed wound thread package P on the framework 28.

This embodiment of thread package carrying means 22, illustrated in FIGS. 2 and 3, may include means in the form of a shelf 29 at the top area thereof for carrying empty sleeves S for use in the spindle assemblies 12 of the thread processing machine 10 for winding of processed thread T thereon to form the wound packages P.

The thread package carrying devices 22 preferably further include roller mechanisms 30 in any suitable form for being positioned within the rail 20 and from which the thread package carrying devices 22 are suspended by shafts 31 for movement along the rail 20. As may be seen in FIGS. 2 and 4, the rail 20 is mounted by frame members 32 suitably connected to the frame of the two-for-one twister textile thread processing machine 10 so as to position the thread package carrying devices 22 between the rows of spindle assemblies 12 and in the vicinity of the wound thread packages P being produced. A predetermined number of thread package carrying device 22 may be provided between each of the opposed rows spindle assemblies 12 so as to form a group of thread package carrying devices 22 for simultaneous or individual movement along the rail 20, as described below.

Figure 5:
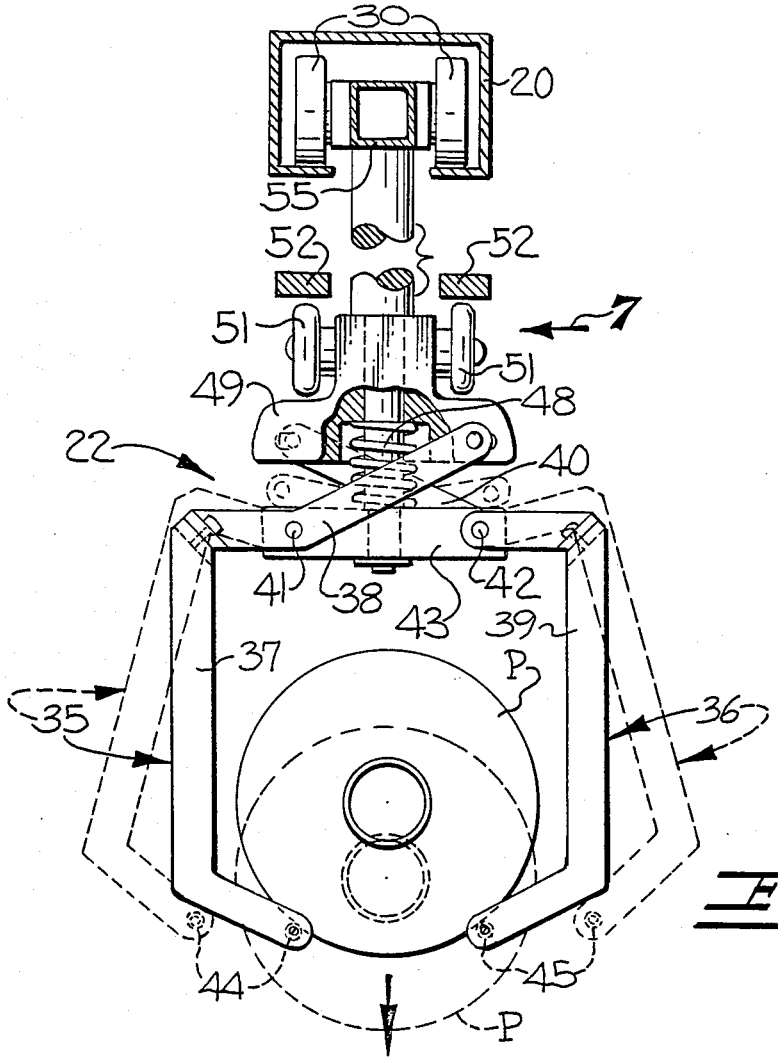
FIG. 5 is an enlarged elevational view, partly in section, of the second embodiment of thread package carrying device illustrated in FIG. 4.
Figure 6:
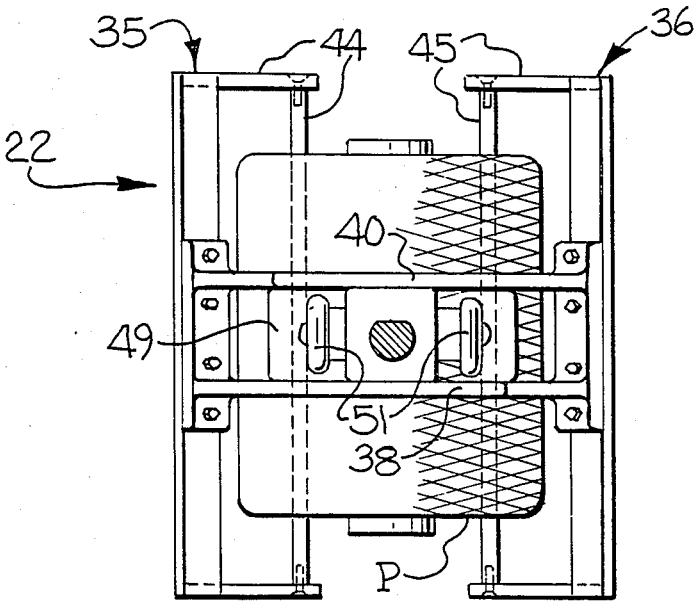
FIG. 6 is a top plan view of the thread package carrying device illustrated in FIG. 5.

Referring now to FIGS. 4, 5 and 6, there is shown a second embodiment of thread package carrying device 22 which comprises a three dimensional open framework, as shown, including spaced-apart longitudinally-extending opposed portions 35, 36 each having open sides and bottom areas and dimensions for receiving therein and cradling the doffed wound thread package P at the bottom areas thereof and being pivotally mounted at top areas thereof to move from a first position, as shown in solid lines in FIGS. 4, 5, 6, wherein the bottom areas are spaced-apart a distance less than the diameter of the wound thread package P for receiving, cradling and carrying the doffed wound thread package P, to a second position, as shown in dotted lines in FIG. 5, wherein the bottom areas are spaced-apart a distance greater than the diameter of the wound thread package P for opening said thread package carrying device 22 and releasing the wound thread package therefrom.

The pivotally mounted portions 35, 36 of the framework 34 comprise generally two-arm lever like systems including lever arms 37, 38 and 39, 40 respectively, pivoted about a generally horizontal axis at 41, 42 to transverse member 43 and the bottom areas thereof comprise generally gripping tong like members 44, 45, as clearly shown in FIGS. 4, 5 and 6.

Figure 7:
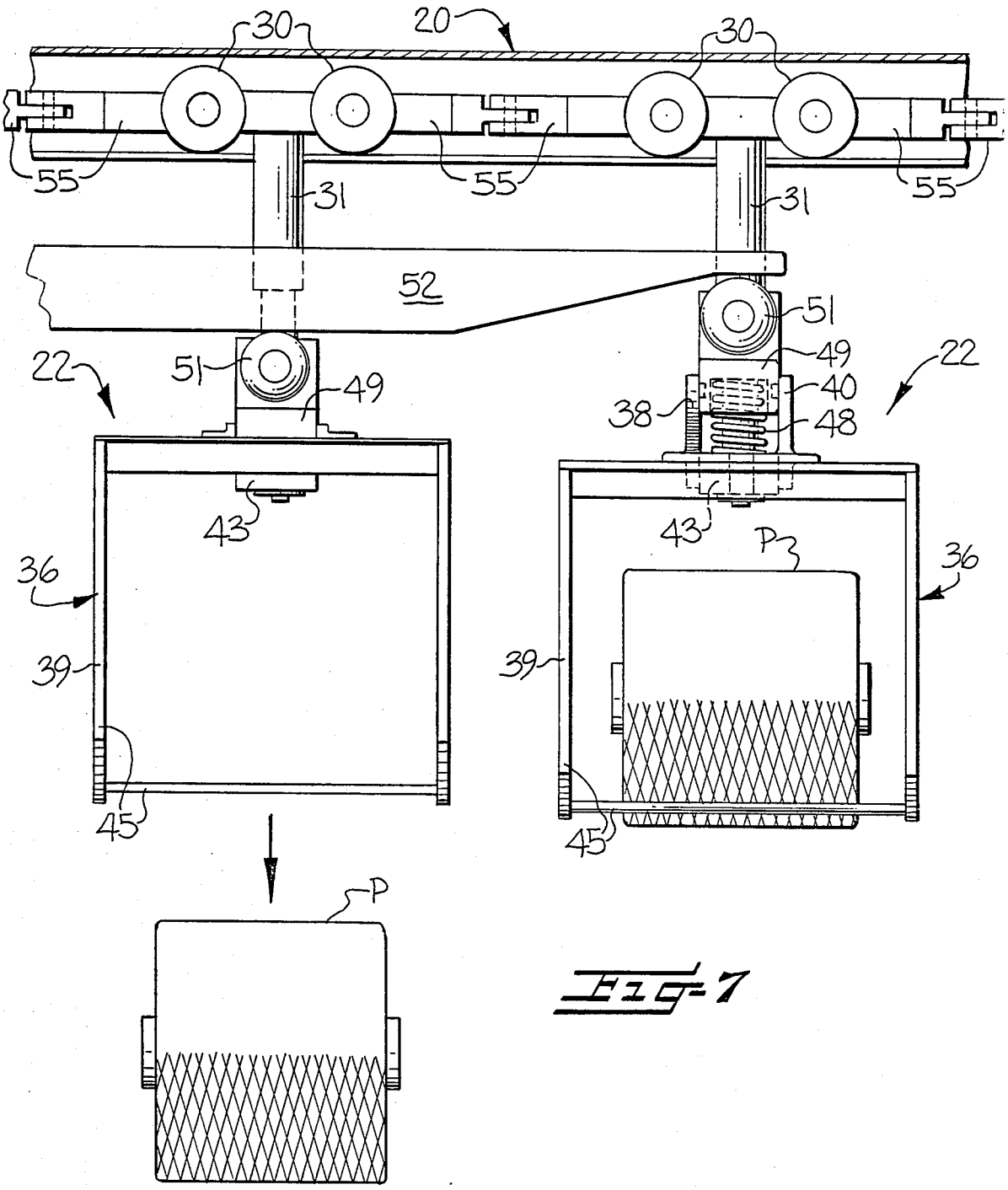
FIG. 7 is a side elevational view, looking in the direction of the arrow 9 of FIG. 7, and further showing the mechanism for opening the thread package carrying device for release of the wound thread package.

Each of the thread package carrying devices 22 of FIGS. 4–6 further include means operatively connected with the pivotally mounted opposed portions 35, 36 for selectively moving these pivotally mounted portions 35, 36 to the second positions, indicated in dotted lines in FIG. 5, and opening the thread package carrying devices 22. These means may comprise a spring 48 positioned between a sleeve member 49, to which the upper end of lever arms 38, 40 are connected, and the transverse member 43 for biasing the two-arm lever systems 37, 38 and 39, 40 to the closed position of the thread package carrying device 22. The sleeve mechanism 49 is slidably mounted on the shaft 31 secured to and depending from roller mechanism 30 and has cam followers 51 secured thereto which are adapted to engage cams 52 positioned at selected locations along the rails 20 so that when the cam followers 51 ride down on the cam 52, the sleeve member 49 will be depressed against the bias of spring 48 to move the lever arms 38, 40 to a downward position, as indicated by the dotted lines in FIG. 5, which in turn pivots the lever arm 37, 39 outwardly about the pivots 41, 42, as shown in dotted lines in FIG. 5, to in turn move the tong like members 44, 45 outwardly to a position in which they are spaced-apart a distance greater than the diameter of the wound thread package P to open the thread package carrying device 22 and allow the wound thread package P to fall by gravity out of the thread package carrying device 22, as indicated by dotted lines in FIGS. 5 and 7. The thus released wound thread package P may be received in one of the additional stations 15, 16 for further processing, packaging, etc. or may be received by a suitable receptacle, conveyor belt, etc., as desired.

Figure 8:
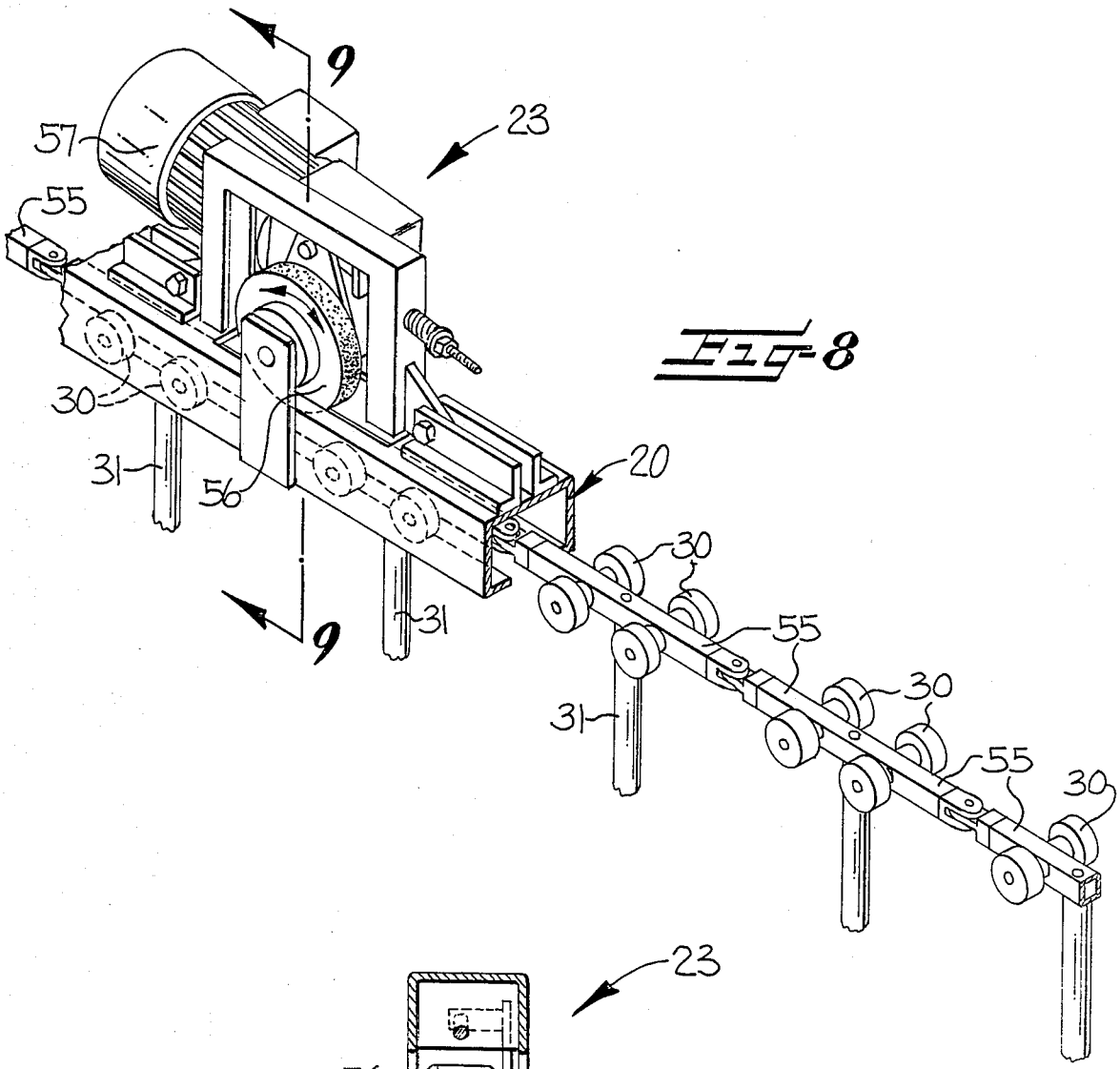
FIG. 8 is a partial perspective view of a drive mechanism for driving the thread package carrying devices along the rail device.
Figure 9:
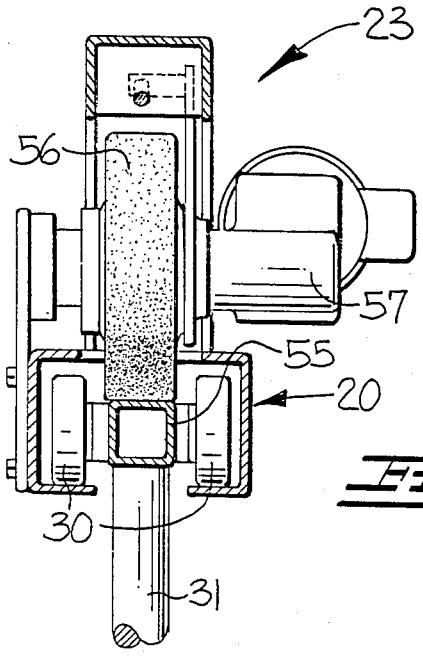
FIG. 9 is a sectional view, taken generally along the line 9—9 of FIG. 8.

The drive means 23, as shown particularly in FIGS. 8 and 9, for driving the thread package carrying devices 22 along the rail 20, may be in the form of rigid links 55 connected together in chain like form and each having a roller mechanism 30 thereon for passing through the rail 20. Each of these links 55 may receive a shaft 31 suspended therefrom for carrying a thread package carrying device 22 so that the thread package carrying device 22 may be grouped in predetermined numbers. Links 55 between predetermined numbers or groups of thread package carrying devices 22 would not have depending shafts 31 and thread package carrying devices 22 thereon. The chain of links 55 may be suitably driven by a friction wheel drive mechanism including a friction wheel 56 engaging the top of the chain of links 55 and selectively driven by a motor 57. Any other arrangement of drive means may be provided.

In the drawing and specification, there have been illustrated and described certain preferred embodiments of this invention, and although specific terms are employed, they are used in a generic and descriptive sense only and not for purposes of limitation.

What is claimed is:

1. An automated textile thread processing system characterized by reducing thread package handling and labor requirements and comprising:

a textile thread processing machine station, such as a twisting, spinning machine, having a plurality of spindle assemblies for processing thread and forming wound packages of processed thread, said spindle assemblies being arranged on said machine in two longitudinally-extending rows on opposite sides of said machine and in spaced side-by-side relationship;

at least one additional station, such as a thread processing machine, packaging mechanism, fabric producing machine, thread package receptacle; and a thread package transporting mechanism comprising elongate stationary continuous rail means passing through said thread processing machine station between said rows of spindle assemblies and to and through said additional station and back to said thread processing machine station, thread package carrying means movably mounted on said rail means and positioned for receiving the wound packages of thread doffed from said spindle assemblies of said thread processing machine station and then carrying the thread packages from said thread processing machine station to said additional station and releasing the thread packages at said additional station and then returning to said thread processing machine station, and drive means for driving said thread package carrying means along said rail means; and each said thread package carrying means comprises a three dimensional framework having a generally triangular transverse cross-section, a generally rectangular bottom, a width less than the diameter of the wound thread package, a height greater than the wound thread package, a length greater than the wound thread package, and open sides to receive the doffed wound thread package therethrough.

2. An automated textile thread processing system, as set forth in claim 1, in which said rail means extends in the form of and defines a closed loop.

3. An automated textile thread processing system, as set forth in claim 2, in which said closed loop exits one end of said thread processing machine station and enters the other end of said thread processing machine station.

4. An automated textile thread processing system, as set forth in claim 3, in which said rail means further includes gate means positioned for being moved from a first position wherein said closed loop exits one end of said thread processing machine and enters the other end of said thread processing machine to a second position bypassing the portion of said closed loop which enters the other end of said thread processing machine and forms and defines a second closed loop which exits and enters the one end of said thread processing machine, whereby a choice of closed loop travel is provided for said thread package carrying means.

5. An automated textile thread processing system, as set forth in claim 4, further comprising a second additional station, such as a thread processing machine, packaging mechanism, fabric producing machine, thread package receptacle, and the like, positioned so that the portion of said rail means, forming said closed loop when said gate means is in its first position, passes therethrough.

6. An automated textile thread processing system, as set forth in claim 1, further comprising means operatively associated with each of said spindle assemblies for doffing the wound package of thread from each of said spindle assemblies into one of said thread package carrying means of said thread package transporting mechanism.

7. An automated textile thread processing system, as set forth in claim 1, in which said thread package carrying means further comprises an open bottom for cradling the doffed wound thread package on said framework.

8. An automated textile thread processing system, as set forth in claim 7, in which said thread package carrying means further comprises means at the top area thereof for carrying empty sleeves for use in said spindle assemblies of said thread processing machine for winding of processed thread thereon to form the wound packages.

9. An automated textile thread processing system, as set forth in claim 7, in which said thread package carrying means further comprises roller means attached to the top thereof for being received within said rail means for movably mounting said thread package carrying means on said rail means.

10. An automated textile thread processing system characterized by reducing the thread package handling and labor requirements and comprising:

a textile thread processing machine station, such as a twisting, spinning machine, having a plurality of spindle assemblies for processing thread and forming wound packages of processed thread, said spindle assemblies being arranged on said machine in two longitudinally-extending rows on opposite sides of said machine and in spaced side-by-side relationship;

at least one additional station, such as a thread processing machine, packaging mechanism, fabric producing machine, thread package receptacle; and a thread package transporting mechanism comprising elongate stationary continuous rail means passing through said thread processing machine station between said rows of spindle assemblies and to and through said additional station and back to said thread processing machine station, thread package carrying means movably mounted on said rail means and positioned for receiving the wound packages of thread doffed from said spindle assemblies of said thread processing machine station and then carrying the thread packages from said thread processing machine station to said additional station and releasing the thread packages at said additional station and then returning to said thread processing machine station, and drive means for driving said thread package carrying means along said rail means; and each of said thread package carrying means comprises a three dimensional framework comprising spaced-apart opposed longitudinally-extending portions each having open sides and bottom areas and dimensions for receiving therein and cradling the doffed wound thread package at the bottom areas and being pivotally mounted at top areas thereof to move from a first position wherein the bottom areas are spaced-apart a distance less than the diameter of the wound thread package for receiving, cradling and carrying the doffed wound thread package to a second position wherein the bottom areas are spaced apart a distance greater than the diameter of the wound thread package for opening said thread package carrying means and releasing the wound thread package therefrom.

11. An automated textile thread processing system, as set forth in claim 10, in which said pivotally mounted portions of said framework comprise generally two-arm lever like systems pivoted about a generally horizontal axis and said bottom area thereof comprise generally gripping tong like members.

12. An automated textile thread processing system, as set forth in claim 11, in which each of said thread package carrying means further comprise means operatively connected with said pivotally mounted portions of said framework for selectively moving said pivotally mounted portions to the second position and opening said thread package carrying means.

13. An automated textile thread processing system, as set forth in claim 12, in which said means for selectively opening said thread package carrying means comprises means biasing said two-arm lever like system to the closed position of said thread package carrying means, cam means positioned at selected locations along said rail means, and can follower means connected to each of said two-arm lever like systems for being moved by said cam means to open each of said thread package carrying means against the bias of said biasing means.

14. An automated textile thread processing system characterized by reducing thread package handling and labor requirements and comprising:

a first station comprising a two-for-one twister textile yarn processing machine having a plurality of spindle assemblies for processing thread and each including a take-up mechanism at a top area thereof for forming wound packages of process thread, said spindle assemblies being arranged on said machine in two longitudinally-extending rows on opposite sides of said machine and in spaced side-by-side relationship;

at least one additional station, such as a thread processing machine, packaging mechanism, fabric producing machine, thread package receptacle;

a thread package transporting mechanism comprising elongate stationary continuous rail means defining a closed loop passing through said two-for-one twister between said rows of spindle assemblies at generally the top area thereof and in the vicinity of said take-up mechanisms and to and through said additional station and back to said two-for-one twister, a predetermined number of thread package carrying means movably mounted on said rail means and positioned for receiving the wound packages of thread doffed from said take-up mechanisms of said two-for-one twister and then carrying the thread packages from said two-for-one twister to said additional station for removal of the thread packages at said additional station and then returning to said two-for-one twister, said thread package carrying means comprising a three dimensional framework having a generally triangular transverse cross-section, a generally rectangular bottom, a width less than the diameter of the wound thread package, a height greater than the wound thread package, a length greater than the wound thread package, open sides to receive the doffed wound thread package therethrough and an open bottom for cradling the doffed wound thread package on said framework, and drive means for driving said predetermined number of thread package carrying means in a group along said rail means; and means operatively associated with each of said spindle assemblies for doffing the wound packages of thread from each of said take-up mechanims into one of said thread package carrying means of said thread package transporting mechanism.

15. An automated textile thread processing system characterized by reducing thread package handling and labor requirements and comprising:

a first station comprising a two-for-one twister textile yarn processing machine having a plurality of spindle assemblies for processing thread and each including a take-up mechanism at a top area thereof for forming wound packages of processed thread, said spindle assemblies being arranged on said machine in two longitudinally-extending rows on opposite sides of said machine and in spaced side-by-side relationship;

at least one additional station, such as a thread processing machine, packaging mechanism, fabric producing machine, package receptacle;

a thread package transporting mechanism comprising elongate stationary continuous rail means defining a closed loop passing through said two-for-one twister between said rows of spindle assemblies at generally the top area thereof and in the vicinity of said take-up mechanisms and to and through said additional station and back to said two-for-one twister, a predetermined number of thread package carrying means movable mounted on said rail means and positioned for receiving the wound packages of thread doffed from said take-up mechanisms of said two-for-one twister and then carrying the thread packages from said two-for-one twister to said additional station and releasing the thread packages at said additional station and then returning to said two-for-one twister, said thread package carrying means comprising a three dimensional framework including spaced-apart opposed longitudinally-extending portions each having open sides and bottom areas and dimensions for receiving therein and cradling the doffed wound thread package at the bottom areas, said opposed longitudinally-extending portions being in the form generally of two-arm lever like systems pivotally mounted about a generally horizontal axis and the bottom areas thereof being in the form of generally gripping tong-like members, and means operatively connected with said pivotally mounted portions of said framework for selectively moving said pivotally mounted portions from a first position wherein the bottom areas are spaced-apart a distance less than the diameter of the wound thread package for receiving, cradling and carrying the doffed wound thread package to a second position wherein the bottom areas are spaced-apart a distance greater than the diameter of the wound thread package for opening said thread package carrying means and releasing the wound thread package therefrom, and drive means for driving said predetermined number of thread package carrying means in a group along said rail means; and means operatively associated with each of said spindle assemblies for doffing the wound packages of thread from each of said take-up mechanisms into one of said thread package carrying means of said thread package transporting mechanism.

16. An automated textile thread processing system, as set forth in claim 15, in which said means for selectively opening said thread package carrying means comprises means biasing said two-arm lever like system to the closed position of said thread package carrying means, cam means positioned at selected locations along said rail means, and cam follower means connected to each of said two-arm lever like systems for being moved by said cam means to open each of said thread package carrying means against the bias of said biasing means.

17. An automated textile thread processing system, as set forth in claim 14 or 15, in which said closed loop of said rail means exits one end of said two-for-one twister and enters the other end of said two-for-one twister, said rail means further includes gate means positioned for being moved from a first position wherein said closed loop exits one end and enters the other end of said two-for-one twister to a second position bypassing the portion of said closed loop which enters the other end of said two-for-one twister and forms and defines a second closed loop which exits and enters the one end of said two-for-one twister whereby a choice of closed loop travel is provided for said thread package carrying means, and in which said automated textile thread processing system further comprises a second additional station, such as a thread processing machine, packaging mechanism, fabric producing machine, thread package receptacle and the like, positioned so that the portion of said rail means, forming said closed loop when said gate means is in its first position, passes therethrough.

18. A thread package carrying means for receiving, carrying and releasing doffed wound thread packages and adapted to be movably mounted on rail means for movement through a textile thread processing machine station and between rows of spindle assemblies therein producing the wound thread packages and arranged therein in two longitudinally-extending rows on opposite sides of the machine and in spaced side-by-side relationship and then to and through an additional station, such as a thread processing machine, packaging mechanism, fabric producing machine, thread package receptacle, and then back to the thread processing machine, said thread package carrying means comprising:

a three dimensional framework including spaced-apart opposed longitudinally-extending portions each having open sides and bottom areas and dimensions for receiving therein and cradling the doffed wound thread package at the bottom areas, said opposed longitudinally-extending portions being in the form generally of two-arm lever like systems pivotally mounted about a generally horizontal axis and the bottom areas thereof being in the form of generally gripping tong-like members, and means operatively connected with said pivotally mounted portions of said framework for selectively moving said pivotally mounted portions from a first position wherein the bottom areas are spaced-apart a distance less than the diameter of the wound thread package for receiving, cradling and carrying the doffed wound thread package to a second position wherein the bottom areas are spaced-apart a distance greater than the diameter of the wound thread package for opening said thread package carrying means and releasing the wound thread package therefrom.

* * * * *